US011223130B2

(12) United States Patent
Chen et al.

(10) Patent No.: US 11,223,130 B2
(45) Date of Patent: Jan. 11, 2022

(54) ANTENNA STRUCTURE

(71) Applicant: CHILISIN ELECTRONICS CORP., Hsinchu County (TW)

(72) Inventors: Yen-Ming Chen, Taoyuan (TW); Chang-Ching Lin, Taoyuan (TW); Yung-Sheng Chang, Taoyuan (TW); Sheng-Che Chang, Taoyuan (TW)

(73) Assignee: CHILISIN ELECTRONICS CORP., Hsinchu County (TW)

( * ) Notice: Subject to any disclaimer, the term of this patent is extended or adjusted under 35 U.S.C. 154(b) by 64 days.

(21) Appl. No.: 16/784,252

(22) Filed: Feb. 7, 2020

(65) Prior Publication Data

US 2021/0249773 A1 Aug. 12, 2021

(51) Int. Cl.
*H01Q 1/38* (2006.01)
*H01Q 9/04* (2006.01)

(52) U.S. Cl.
CPC ..... *H01Q 9/045* (2013.01); *H01Q 9/0414* (2013.01)

(58) Field of Classification Search
CPC ..... H01Q 9/045; H01Q 9/041
See application file for complete search history.

(56) References Cited

U.S. PATENT DOCUMENTS 7,116,274 B2 10/2006 Huang et al.
8,674,882 B2 3/2014 Huang et al.
2009/0295645 A1* 12/2009 Campero ..... H01Q 9/0407 343/700 MS
2015/0102977 A1* 4/2015 Lockyear ..... H01Q 9/0407 343/893

FOREIGN PATENT DOCUMENTS

JP 2007097115 A * 4/2007
TW 201236265 A1 9/2012

* cited by examiner

*Primary Examiner* — Dieu Hien T Duong
(74) *Attorney, Agent, or Firm* — Li & Cai Intellectual Property (USA) Office

(57) ABSTRACT

An antenna structure includes a feeding layer, a resonation layer, and a ground layer. The feeding layer is configured for receiving an antenna feeding signal. The resonation layer is disposed at an area surrounding the feeding layer. A first predetermined distance is defined between the resonation layer and the feeding layer. The ground layer is disposed at a side of the feeding layer and the resonation layer. A second predetermined distance is defined between the ground layer and resonation layer. The ground layer includes a first support portion and a second support portion. The ground layer is not electrically connected to the feeding layer. The resonation layer is electrically connected to the first support portion and the second support portion of the ground layer.

8 Claims, 5 Drawing Sheets

ANTENNA STRUCTURE

FIELD OF THE DISCLOSURE

The present disclosure relates to an antenna structure, and more particularly to a dual-band antenna structure.

BACKGROUND OF THE DISCLOSURE

In general, the size of a dual-band antenna is very large. There are considerable technical difficulties that may occur in the manufacturing process of the dual-band antenna. Therefore, process yield is affected, and cost cannot be effectively reduced.

It is now an important issue in the industry to provide a dual-frequency antenna that is manufactured with low cost and has a simple structure.

SUMMARY OF THE DISCLOSURE

In response to the above-referenced technical inadequacies, the present disclosure provides an antenna structure. The antenna structure includes a feeding layer, a resonation layer, and a ground layer. The feeding layer is configured for receiving an antenna feeding signal. The resonation layer is disposed at an area surrounding the feeding layer. A first predetermined distance is defined between the resonation layer and the feeding layer. The ground layer is disposed at a side of the feeding layer and the resonation layer. A second predetermined distance is defined between the ground layer and resonation layer. The ground layer includes a first support portion and a second support portion. The ground layer is not electrically connected to the feeding layer. The resonation layer is electrically connected to the first support portion and the second support portion of the ground layer.

In one aspect, the present disclosure provides an antenna structure. The antenna structure includes a feeding layer, a resonation layer, and a ground layer. The feeding layer is configured for receiving an antenna feeding signal. The resonation layer is electrically connected to the ground layer by two support portions. A predetermined distance is defined between the resonation layer and the ground layer. The feeding layer, the two supporting portions, and the ground structure layer form a U-shaped structure. The feeding layer is disposed at a top side of the U-shaped structure. The feeding layer is not electrically connected to the resonation layer, the two support portions, and the ground layer.

Therefore, the antenna structure provided by the present disclosure has a simple structure, wide frequency bands, and a compact size. Accordingly, a manufacturing cost and an assembly cost can be reduced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
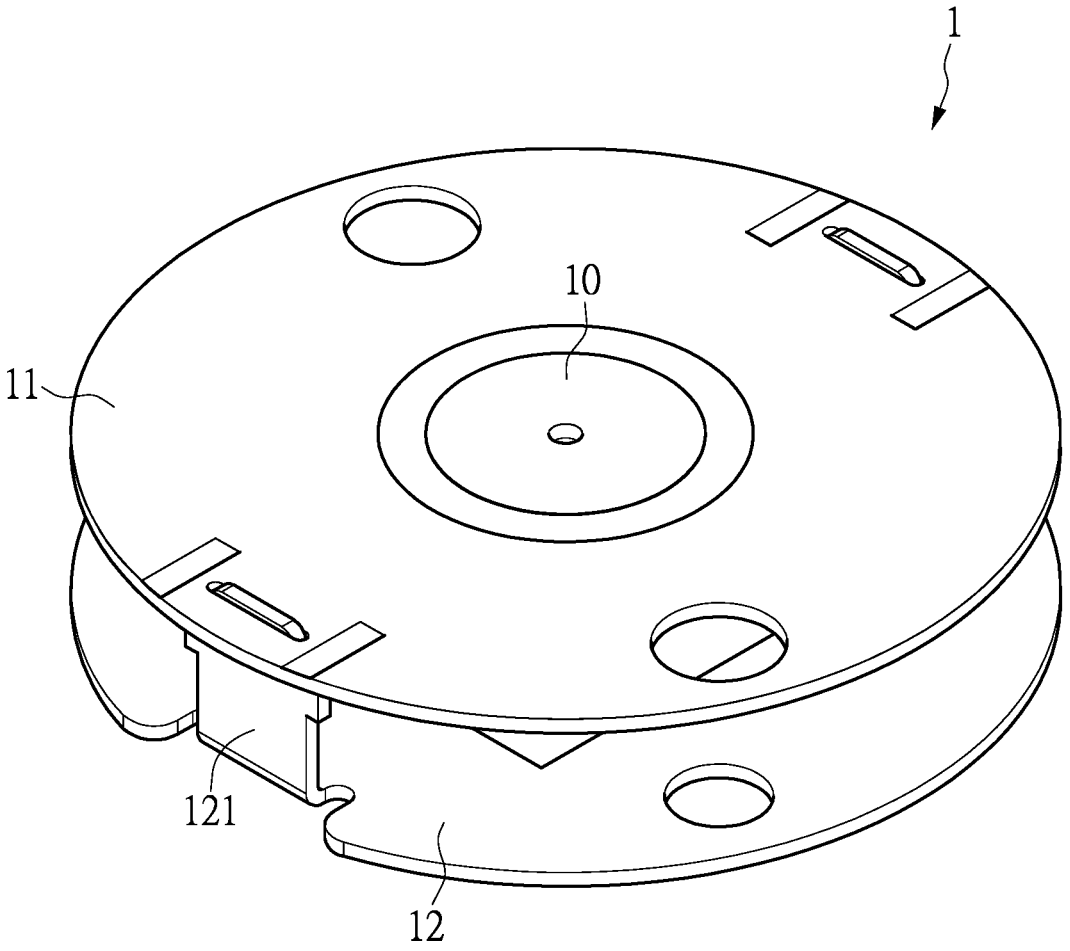
FIG. 1 is a schematic view of an antenna structure of a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
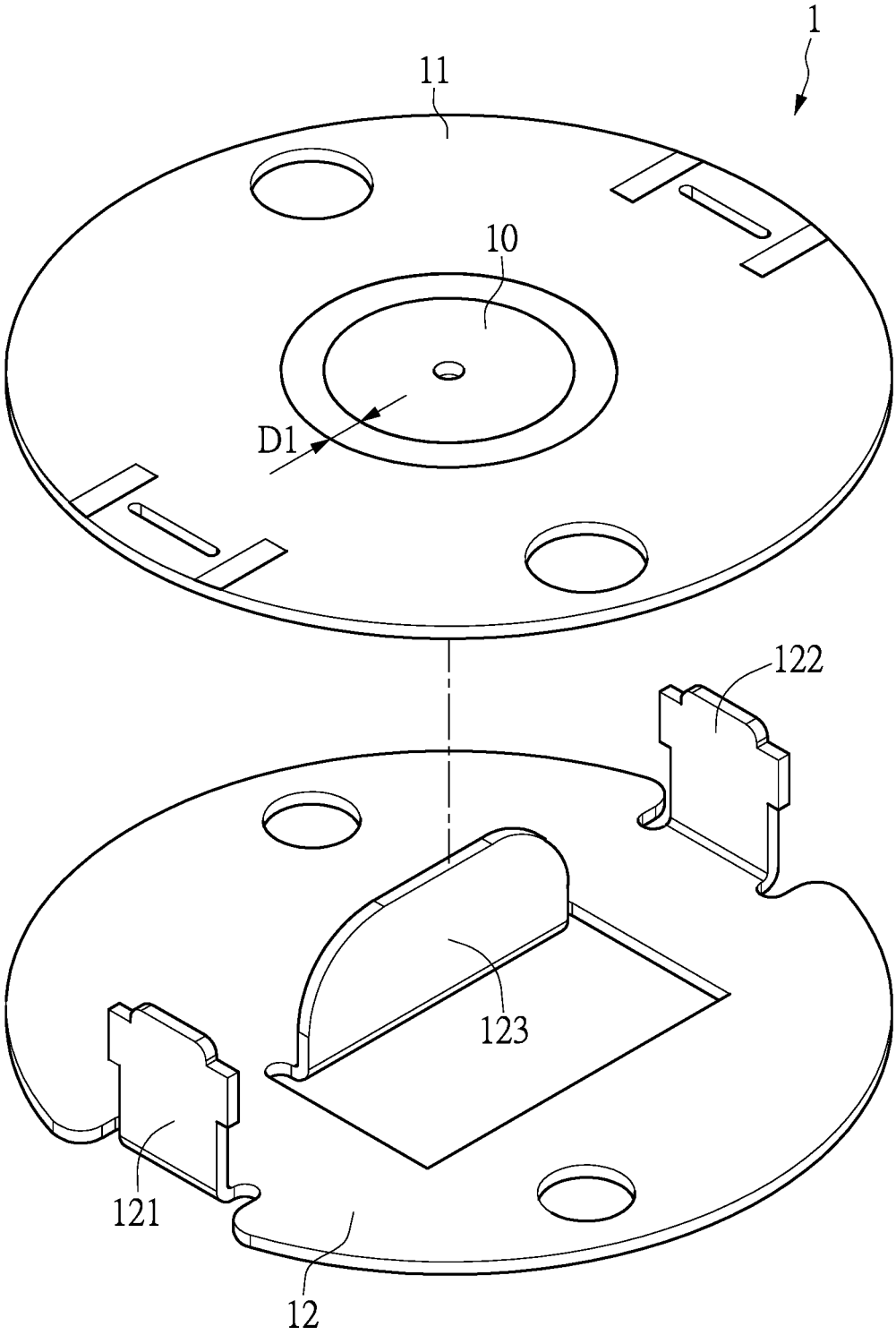
FIG. 2 is an exploded view of the antenna structure in FIG. 1.
Figure 3:
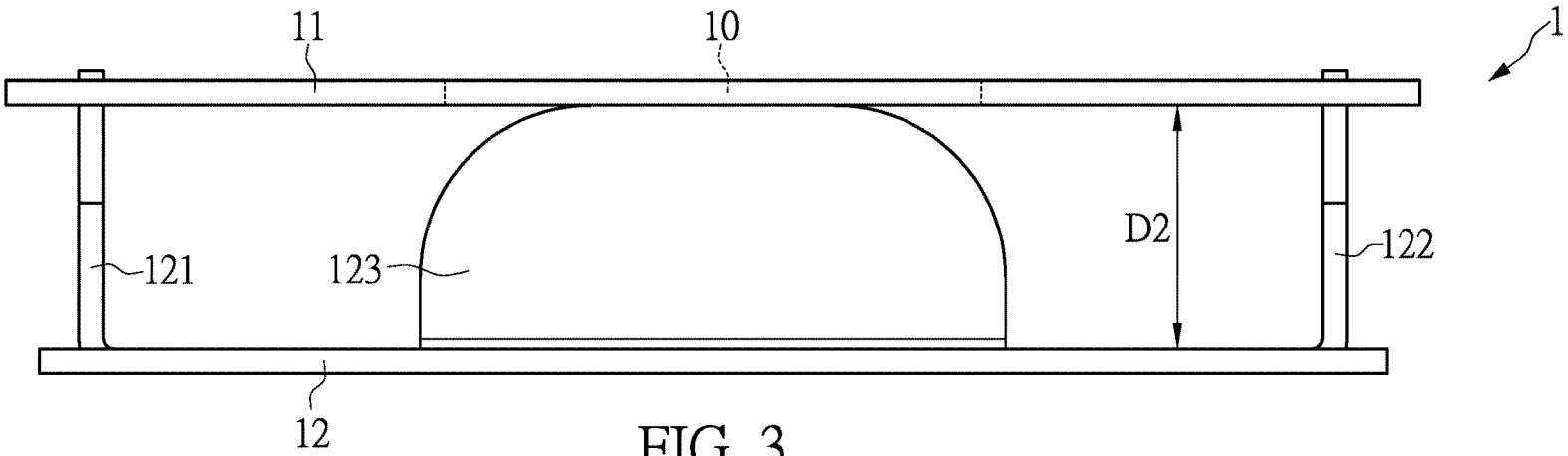
FIG. 3 is a side view of the antenna structure in FIG. 1.

Referring to FIG. 1, FIG. 2, and FIG. 3, FIG. 1 is a schematic view of an antenna structure of a first embodiment of the present disclosure. FIG. 2 is an exploded view of the antenna structure in FIG. 1. FIG. 3 is a side view of the antenna structure in FIG. 1.

An antenna structure 1 is an antenna with two layers. In the embodiment, the antenna structure 1 includes a feeding layer 10, a resonation layer 11, and a ground layer 12. The ground layer 12 includes a first support portion 121, a second support portion 122, and a third support portion 123.

The feeding layer 10 has a feeding hole 101 used for being electrically connected to a communication cable to receive an antenna signal. The resonation layer 11 is disposed at an area surrounding the feeding layer 10. A first predetermined distance D1 is defined between the feeding layer 10 and the resonation layer 11. The ground layer 12 is disposed at a side of the feeding layer 10 and the resonation layer 11. A second predetermined distance D2 is defined between the ground layer 12 and the resonation layer 11. In other words, the feeding layer 10 and the resonation layer 11 are disposed at a top side of the ground layer 12. The second predetermined distance D2 is between 2 mm to 7 mm.

In addition, the first support portion 121 and the second support 122 are extended from two opposite sides of the ground layer 12. The resonation layer 11 is electrically connected to the ground layer 12 through the first support portion 121 and the second support portion 122. In other embodiments, the first support portion 121 and the second support portion 122 may not be disposed on the two opposite sides of the ground layer 12. The first support portion 121 and the second support portion 122 may be disposed on the two sides of the ground layer 12 adjacent to each other. In addition, a number of the support portions of the ground structure layer 12 can be adjusted, and is not limited in the present disclosure. In the embodiment, receiving holes (not shown) for accommodating the first supporting portion 121 and the second supporting portion 122 are disposed in the resonation layer 11. When the first support portion 121 and the second support portion 122 are inserted into the receiving holes (not shown), the first support portion 121 and the second support portion 122 can be electrically connected by a conductive material. For example, the first support portion 121 and the second support portion 122 are electrically connected to the resonation layer 11 by electric welding or a conductive adhesive.

Due to the first predetermined distance D1 between the feeding layer 10 and the resonation layer 11, the feeding layer 10 is not electrically connected to the resonation layer 11, and the feeding layer 10 is also not electrically connected to the ground layer 12. The third support portion 123 is disposed in a central area of the ground layer 12 to contact and support the feeding layer 10. In the embodiment, the third support portion 123 is formed by cutting and bending the central area of the ground layer 12. In other embodiments, a separate support element can be disposed between the ground layer 12 and the feeding layer 10.

In the embodiment, the feeding layer 10 and the resonation layer 11 are disposed at a same plane. In other words, the feeding layer 10 and the resonation layer 11 may be disposed on a substrate or disposed on two different substrates at a same distance from the ground layer 12.

Moreover, the feeding layer 10 and the resonation layer 12 can be disposed on different substrates or disposed at different planes. In other words, a distance between the feeding layer 10 and the ground layer 12 and a distance between the resonation layer 11 and the ground layer 12 are different. The feeding layer 10 and the resonation layer 11 are disposed on the different planes. A third predetermined distance D3 is defined between feeding layer 10 and the resonation layer 11 in a vertical direction.

Figure 4:
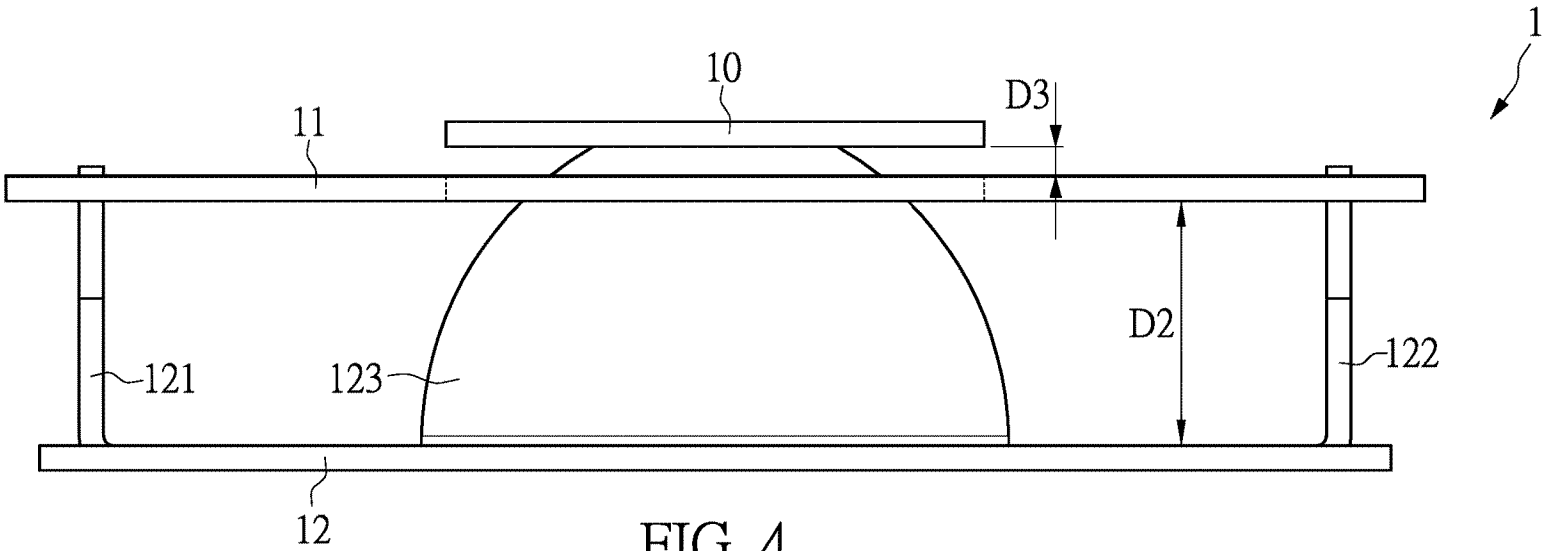
FIG. 4 is a schematic view showing a feeding layer and a resonation layer not being disposed at a same plane.
Figure 5:
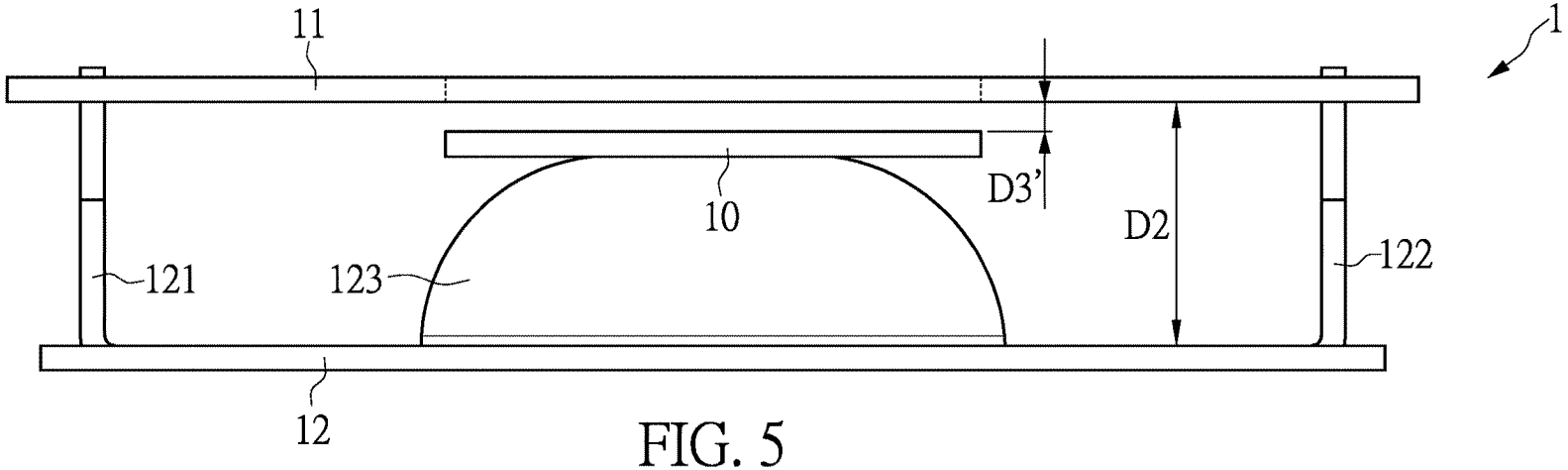
FIG. 5 is another schematic view showing the feeding layer and the resonation layer being disposed at the same plane.

Referring to FIG. 4 and FIG. 5, FIG. 4 is a schematic view showing a feeding layer and a resonation layer not being disposed at a same plane. FIG. 5 is another schematic view showing the feeding layer and the resonation layer being disposed at the same plane.

In FIG. 4, the feeding layer 10 and the resonation layer 11 are disposed on the different planes, and the feeding layer 10 is higher than the resonation layer 11 by a third predetermined distance D3. In other words, a height of the third support portion 123 is higher than the second distance D2 between the resonation layer 11 and the ground layer 12.

In FIG. 5, the feeding layer 10 and the resonation layer 11 are disposed on the different planes, and the feeding layer 10 is lower than the resonation layer 11 by a third predetermined distance D3'. In other words, a height of the third support portion 123 is lower than the second distance D2 between the resonation layer 11 and the ground layer 12. In the embodiment, the third predetermined distance D3, D3' is between 0 mm to 2 mm, In the embodiment, the feeding layer 10, the resonation layer 11, and the ground layer 12 are made of metal. An insulation layer is disposed at a bottom side of the feeding layer 10. Therefore, the feeding layer 10 is not electrically connected to the ground layer 12.

In other embodiments, the third support portion 123 may be made of an insulating material and disposed between the feeding layer 10 and the ground layer 12.

Figure 6:
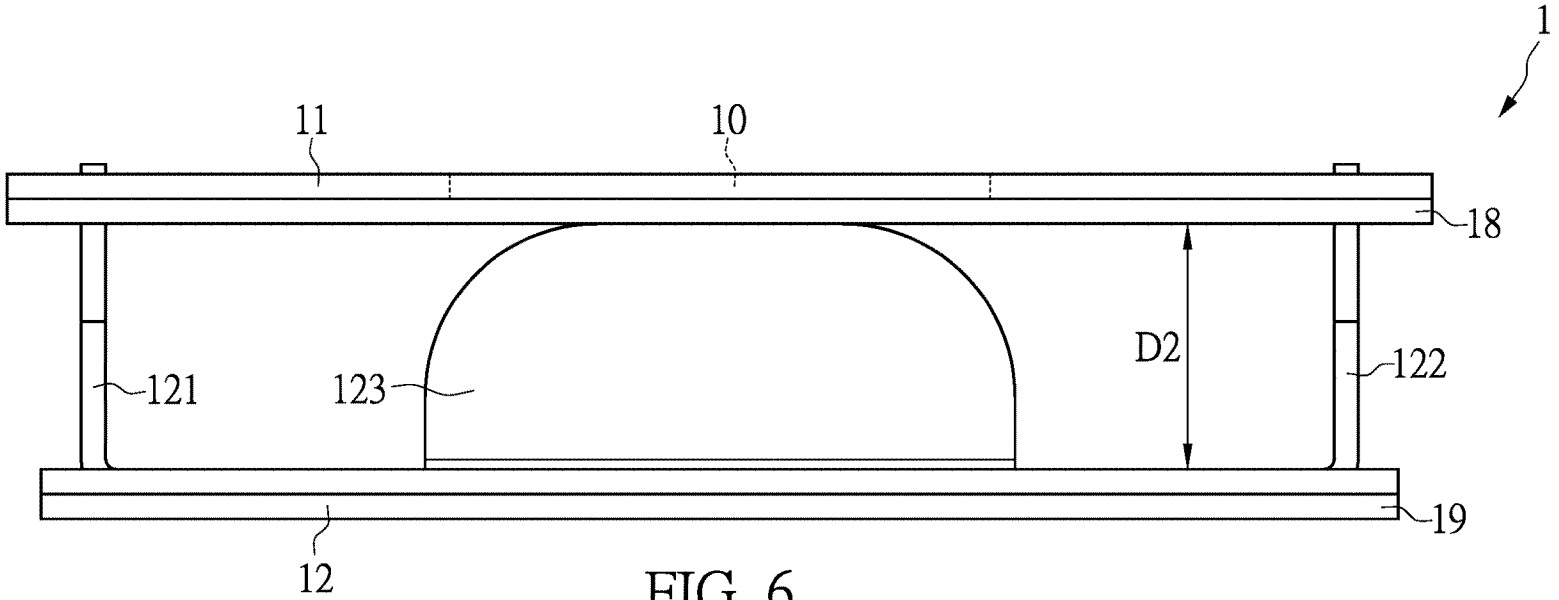
FIG. 6 is another side view of the antenna structure in FIG. 1.

Referring to FIG. 6, FIG. 6 is another side view of the antenna structure in FIG. 1.

The feeding layer 10 and the resonation layer 11 are disposed on an insulation layer 18.

In the embodiment, the insulation layer 18 is a printed circuit board made of a FR4 material. In other embodiments, the insulation layer 18 can be made of plastic, rubber or carbon fiber.

In addition, the ground layer 12 is made of metal, or made of metal that is disposed on an insulation layer 19. A material of the insulation layer 19 is the same with that of the insulation layer 18, but the present disclosure is not limited thereto.

In other words, the resonation layer 11, two support portions 121, 122, and the ground layer 12 form a U-shaped structure. The feeding layer 11 is disposed at the top side of the U-shaped structure formed by the resonation layer 11, the two support portions 121, 122, and the ground layer 12. In addition, the feeding layer 10 is not electrically connected to the resonation layer 11, the two support portions 121, 122, and the ground layer 12. Therefore, the antenna structure of the present disclosure is provided. In the embodiment, a shape of the feeding layer 10 and the resonation layer 11 is a mirror-symmetric polygon, a mirror-symmetric irregular shape, an ellipse, or a circle.

Second Embodiment

Figure 7:
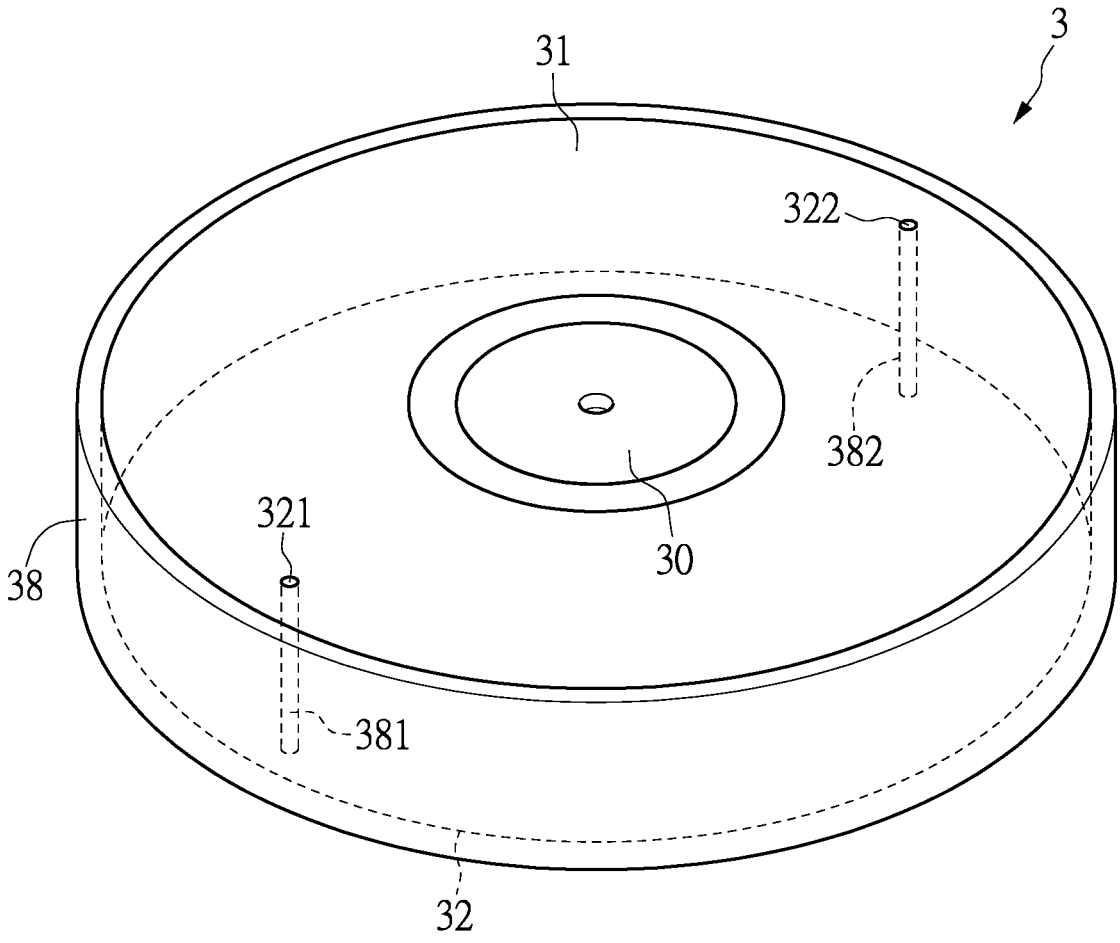
FIG. 7 is a schematic view of an antenna structure of a second embodiment of the present disclosure.

Referring to FIG. 7, FIG. 7 is a schematic view of an antenna structure of a second embodiment of the present disclosure.

An antenna structure 3 is an antenna with two layers. In the embodiment, the antenna structure 3 includes a feeding layer 30, a resonation layer 31, and a ground layer 32. A support layer 38 is disposed between the feeding layer 30, the resonation layer 31, and the ground layer 32. The support layer 38 is made of plastic, acrylic, rubber or carbon fiber, but is not limited thereto in the present disclosure. In the embodiment, a first through hole 381 and a second through hole 382 are disposed at the support layer 38. The first through hole 381 and the second through hole 382 are filled by a conducting material to form a first conducting pin 321 and a second conducting pin 322. The resonation layer 31 is electrically connected to the ground layer 32 through the first conducting pin 321 and the second conducting pin 322. In the embodiment, shapes and numbers of the through hole and the conducting pin are adjusted based on actual requirements, and is not limited thereto in the present disclosure.

A structure of the antenna structures 1 and the antenna structure 3 in the embodiment is not only simple, but can also provide two different frequency bands of 2.4 GHz to 2.54 GHz and 5.15 GHz to 7.2 GHz by resonating the feeding layer and the resonation layer. In addition, a plurality of antenna structures 1 or antenna structures 3 of the present disclosure (e.g., 4 to 6 antenna structures) can be provided in a radial manner. Therefore, a good signal transmission performance can be obtained in different directions.

In conclusion, the antenna structure provided by the present disclosure has a simple structure, wide frequency bands, and a compact size. Accordingly, manufacturing cost and assembly cost can be reduced.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a feeding layer configured for receiving an antenna feeding signal;

a resonation layer disposed at an area surrounding the feeding layer, a first predetermined distance being defined between the resonation layer and the feeding layer; and a ground layer disposed at a side of the feeding layer and the resonation layer, a second predetermined distance being defined between the ground layer and resonation layer, and the ground layer including a first support portion and a second support portion;

wherein the ground layer is not electrically connected to the feeding layer, and the resonation layer is electrically connected to the first support portion and the second support portion of the ground layer;

wherein the ground layer further includes a third support portion that is disposed in a central area of the ground layer and that supports the feeding layer, the third support portion of the ground layer is made of metal and connected to the ground layer;

wherein an insulation material layer is disposed at a bottom side of the feeding layer and the insulation material layer is disposed between the third support portion and the feeding layer.

2. The antenna structure of claim 1, wherein the feeding layer and the resonation layer are disposed at a same plane.

3. The antenna structure of claim 1, wherein the feeding layer and the resonation layer are disposed at different planes, and a third predetermined distance is defined between the feeding layer and the resonation layer in a vertical direction.

4. The antenna structure of claim 1, wherein the feeding layer, the resonation layer, and the ground layer are made of metal.

5. The antenna structure of claim 4, wherein the feeding layer and the resonation layer are disposed on an insulation layer.

6. The antenna structure of claim 5, wherein the insulation layer is a printed circuit board, a plastic, a rubber, or a carbon fiber.

7. The antenna structure of claim 1, wherein a shape of the resonation layer is a mirror-symmetric polygon, a mirror-symmetric irregular shape, an ellipse, or a circle.

8. An antenna structure, comprising:

a feeding layer configured for receiving an antenna feeding signal;

a resonation layer; and a ground layer, wherein the resonation layer is electrically connected to the ground layer by a first support portion and a second support portion, a predetermined distance is defined between the resonation layer and the ground layer, and the resonant layer, the two supporting portions, and the ground layer form a U-shaped structure;

wherein the feeding layer is disposed at a top side of the U-shaped structure, and the feeding layer is not electrically connected to the resonation layer, the two support portions, and the ground layer, wherein the ground layer further includes a third support portion that is disposed in a central area of the ground layer and that supports the feeding layer, the third support portion of the ground layer is made of metal and connected to the ground layer;

wherein an insulation material layer is disposed at a bottom side of the feeding layer and the insulation material layer is disposed between the third support portion and the feeding layer.

* * * * *